US006343999B1

(12) United States Patent
Murtland et al.

(10) Patent No.: US 6,343,999 B1
(45) Date of Patent: Feb. 5, 2002

(54) SET OF GOLF CLUB SHAFTS

(75) Inventors: Richard H. Murtland, Dallas; Robert M. Boyd, Lewisville; Brian W. Johansen, McKinney, all of TX (US); Robert Bush, Germantown, TN (US); Byron H. Adams, Dallas, TX (US)

(73) Assignee: Adams Golf IP LP, Plano, TX (US)

( * ) Notice: Subject to any disclaimer, the term of this patent is extended or adjusted under 35 U.S.C. 154(b) by 0 days.

(21) Appl. No.: 09/671,324

(22) Filed: Sep. 26, 2000

Related U.S. Application Data

(63) Continuation-in-part of application No. 09/399,332, filed on Sep. 20, 1999.

(51) Int. Cl.[7] ..... A63B 53/10; A63B 53/12
(52) U.S. Cl. ..... 473/289; 473/320
(58) Field of Search ..... 473/287, 288, 473/289, 299, 320, 321, 316

(56) References Cited

U.S. PATENT DOCUMENTS

| | | | | |
|---|---|---|---|---|
| 1,426,202 | A | | 8/1922 | Lard |
| 1,586,469 | A | | 5/1926 | Revell |
| 1,774,385 | A | | 8/1930 | Lard |
| 1,968,616 | A | | 7/1934 | Oldham |
| 2,250,428 | A | * | 7/1941 | Vickery |
| 2,250,429 | A | | 7/1941 | Vickery |
| 2,464,850 | A | | 3/1949 | Crawshaw |
| 3,206,205 | A | | 9/1965 | McLoughlin |
| 236,735 | A | | 9/1975 | Bush ..... D21/2 |
| 4,157,181 | A | | 6/1979 | Cecka |
| 4,340,227 | A | * | 7/1982 | Dopkowski |
| 4,836,545 | A | | 6/1989 | Pompa |
| 5,083,780 | A | | 1/1992 | Walton et al. |
| 5,184,819 | A | | 2/1993 | Desbiolles |
| 5,253,867 | A | | 10/1993 | Gafner |
| 5,259,614 | A | | 11/1993 | Greer |
| 5,277,423 | A | | 1/1994 | Artus |
| 5,294,119 | A | | 3/1994 | Vincent et al. |
| 5,335,909 | A | | 8/1994 | Green, Jr. |
| 5,390,921 | A | | 2/1995 | De Ruyter |
| 5,465,959 | A | | 11/1995 | Cheng |
| 5,499,814 | A | | 3/1996 | Lu |
| 5,599,242 | A | | 2/1997 | Solviche et al. |
| 5,626,529 | A | | 5/1997 | Roy |
| 5,643,105 | A | | 7/1997 | Niswander |
| 5,674,134 | A | | 10/1997 | Blankenship ..... 473/296 |
| 5,692,970 | A | | 12/1997 | Nelson ..... 473/318 |
| 5,735,751 | A | | 4/1998 | Antonious ..... 473/317 |
| 5,788,585 | A | | 8/1998 | Jackson ..... 473/292 |
| 5,820,483 | A | | 10/1998 | Preece et al. ..... 473/316 |
| 5,857,921 | A | | 1/1999 | Braly et al. ..... 473/289 |
| 5,857,923 | A | | 1/1999 | Veller ..... 473/316 |
| 5,904,627 | A | | 5/1999 | Miyaji et al. ..... 473/319 |
| 5,921,870 | A | | 7/1999 | Chiasson ..... 473/317 |

OTHER PUBLICATIONS

Pat Simmons Golf Shaft circa 1970's.
Photograph by Gary Newkirk, Golf World, Jun. 25, 1999.

* cited by examiner

*Primary Examiner*—Stephen Blau
(74) *Attorney, Agent, or Firm*—Welsh & Flaxman LLC

(57) ABSTRACT

The invention relates to a set of golf clubs employing a two-piece golf club shaft wherein the lengths of the first and second shaft members vary as the loft of the golf club varies. The set of clubs includes a plurality of golf clubs having varying lofts extending from lower loft golf clubs to higher loft golf clubs, wherein each golf club includes a club head and a shaft having a distal end and a butt. Each shaft includes a first member having a first end located at the butt end of the golf club shaft and a second end positioned slightly short of the distal end of the golf club shaft. A second member is secured to the second end of the first member. The second member extends from the second end of the first member to the distal end of the golf club shaft and includes a first end securely coupled to the second end of the first member and a second end which is ultimately secured to a golf club head. The second member progressively decreases in length as the plurality of golf clubs extend from the lower lofted golf clubs to the higher lofted golf clubs.

9 Claims, 2 Drawing Sheets

SET OF GOLF CLUB SHAFTS

RELATED APPLICATIONS

The present invention is a continuation-in-part of U.S. patent application Ser. No. 09/399,332, filed Sep. 20, 1999, by B. H. Adams et al. titled Golf Club Shaft. The description and drawings of this application are incorporated herein by reference.

BACKGROUND OF THE INVENTION

1. Field of the Invention

The invention relates to a set of golf clubs. More particularly, the invention relates to a set of golf clubs employing a two-piece golf club shaft wherein the lengths of the first and second shaft members vary as the loft of the golf club varies.

2. Description of the Prior Art

Since golf clubs have been manufactured in sets, it has been an objective in the manufacture of golf clubs to achieve a degree of consistency such that variations between clubs occur within a predictable pattern. In the early days of golf, wooden shafts, most often made from hickory, were used for golf clubs. It was difficult to match a set of golf clubs with these wooden shafts. Occasionally players with an extraordinary feel could find a set of clubs that were fairly closely matched by individually testing each club until a proper feel was obtained.

With the advent of steel golf club shafts, wooden shafts became a thing of the past. Steel is isotropic in nature and, therefore, provides the mechanical consistency to enable a set of golf clubs to be closely matched in playability.

In recent years, golf club shafts have been made from carbon fiber composites, commonly known as graphite shafts. The graphite shafts have an increased strength to weight characteristic which allows a shaft, and ultimately a golf club, to be made lighter. In addition, graphite provides an increased vibration absorption capability, thereby creating a softer feel when a club impacts a golf ball. The ability of carbon fiber composite shafts to absorb vibrations generated upon striking a golf ball is not only favorable in improving the general feel of a golf club, but is immensely valuable to those suffering from various physical ailments, including, arthritis or tendinitis.

Graphite shafts are typically made by wrapping flags of resin pre-pregged carbon fiber on a mandrel and suitably curing the resin in an oven. Other graphite shafts are made by winding a pre-pregged carbon fiber tow on a mandrel and heating to cure the epoxy.

While carbon fiber composite shafts are generally lighter than prior steel shafts, they exhibit a variety of shortcomings. For example, carbon fiber shafts are commonly inconsistent in feel and mechanical properties. From a manufacturing perspective, it is very difficult and expensive to generate matched sets of golf clubs utilizing carbon fiber composite shafts. Currently there is no cost effective way to produce, in volume, shafts overcoming the shortcomings discussed above.

With this in mind, the manufacture of a set of consistently playable irons is very difficult where one wishes to utilize carbon fiber composite shafts. The relative mechanical inconsistency of the carbon fiber composite materials makes for a set of irons with widely varying playability. This inconsistency is highly undesirable where golfers wish to clearly utilize a set of interrelated golf clubs having the same feel and mechanical characteristics.

Attempts have been made in the past to create a two-piece composite golf shaft. For example U.S. Pat. No. 4,836,545 to Pompa, is directed to a two-piece composite golf shaft having a lower metallic tip section and an upper butt section made of a fiber resin composite or graphite, the term commonly used in the golf industry. The two sections are telescopically fit together and bonded. However, the two-piece composite golf shaft disclosed by Pompa fails to provide a golf shaft exhibiting the desired mechanical consistency, vibration, dampening, stabilization and flex varying characteristics desired by a wide range of golfers.

In addition, Pat Simmons attempted to develop a steel/graphite shaft in the mid 1970s. The shaft included an upper section composed of steel and a lower section composed of graphite. The lower section accounted for approximately 30% of the total length of the golf club shaft. Simmons' shaft, however, failed to take advantage of the positive features of steel and graphite. Specifically, the length of the lower section maintained many of the negative features of graphite in the composite shaft, while providing a structure which readily broke under the force of striking a golf ball. In addition, the length of the lower section took away the bending and consistency provided by a standard steel shaft.

In developing the shaft described in the '332 application it has been found that there is a tendency for longer, less lofted irons and woods to develop greater vibration, bending and torsion. This is primarily due to the increased forces which are applied to these golf clubs as they are swung; it being appreciated that the clubs are longer and, therefore, are swung in a greater arc with correspondingly greater centrifugal forces. Greater forces are also produced by these longer, lower loft clubs because of the tendency of the golfer to hit a golf ball farther and with a more aggressive swing. This is opposed to shorter clubs which generally are swung slower and with more finesse.

Furthermore, the longer golf clubs create a greater swing speed for a given force, which produces greater vibrational effects when a golf ball is struck. The vibrations are even more pronounced when the ball is not struck precisely on the center of percussion of a club head.

It will be appreciated that golf clubs made with a shaft having a standardized graphite section transfer more of the aforementioned undesirable characteristics to the golfer's hands when longer clubs are used during the execution of a golf shot. As such, a need exists for a set of golf shafts compensating for the differing requirements of low lofted and high lofted golf clubs. The present invention provides such a set of golf clubs.

SUMMARY OF THE INVENTION

It is, therefore, an object of the present invention to provide a set of golf clubs employing a two-piece golf club shaft wherein the lengths of the first and second shaft members vary as the loft of the golf club varies. The set of clubs includes a plurality of golf clubs having varying lofts extending from lower loft golf clubs to higher loft golf clubs, wherein each golf club includes a club head and a shaft having a distal end and a butt. Each shaft includes a first member having a first end located at the butt end of the golf club shaft and a second end positioned slightly short of the distal end of the golf club shaft. A second member is secured to the second end of the first member. The second member extends from the second end of the first member to the distal end of the golf club shaft and includes a first end securely coupled to the second end of the first member and a second end which is ultimately secured to a golf club head. The second member progressively decreases in length as the plurality of golf clubs extend from the lower lofted golf clubs to the higher lofted golf clubs.

It is also an object of the present invention to provide a set of golf clubs wherein the first member is formed from a rigid material offering mechanical consistency and the second member is formed from a vibration absorbing material which absorbs undesirable vibrations resulting from an individual striking a golf ball.

It is a further object of the present invention to provide a set of golf clubs wherein the first member is formed from a rigid material offering mechanical consistency and the second member is formed from a material controlling the bending and torsional stiffness at the distal end of the golf club shaft upon striking a golf ball to thereby stabilize a golf club head secured to the distal end of the golf club shaft.

It is another object of the present invention to provide a set of golf clubs wherein the second member is formed from a synthetic chemical compound.

It is still another object of the present invention to provide a set of golf clubs wherein the second member is formed from a fiberglass reinforced resin.

It is yet a further object of the present invention to provide a set of golf clubs wherein the second member is formed from a carbon fiber reinforced resin.

It is also an object of the present invention to provide a set of golf clubs wherein the first member is formed from steel.

It is another object of the present invention to provide a set of golf clubs wherein the second member is approximately 6.25 inches in length for the lowest loft golf club and the second member is approximately 3 inches for the highest loft golf club.

It is a further object of the present invention to provide a set of golf clubs wherein the second member is a solid core construction.

It is also an object of the present invention to provide a set of golf clubs wherein said second member of each golf club shaft is progressively longer as the overall length of the golf club increases.

Other objects, advantages and salient features of the invention will become apparent from the following detailed description, which taken in conjunction with the annexed drawings, discloses a preferred, but non-limiting, embodiment of the subject invention.

DESCRIPTION OF THE PREFERRED EMBODIMENTS

The detailed embodiments of the present invention are disclosed herein. It should be understood, however, that the disclosed embodiments are merely exemplary of the invention, which may be embodied in various forms. Therefore, the details disclosed herein are not to be interpreted as limited, but merely as the basis for the claims and as a basis for teaching one skilled in the art how to make and/or use the invention.

Figures 1, 2, 3:
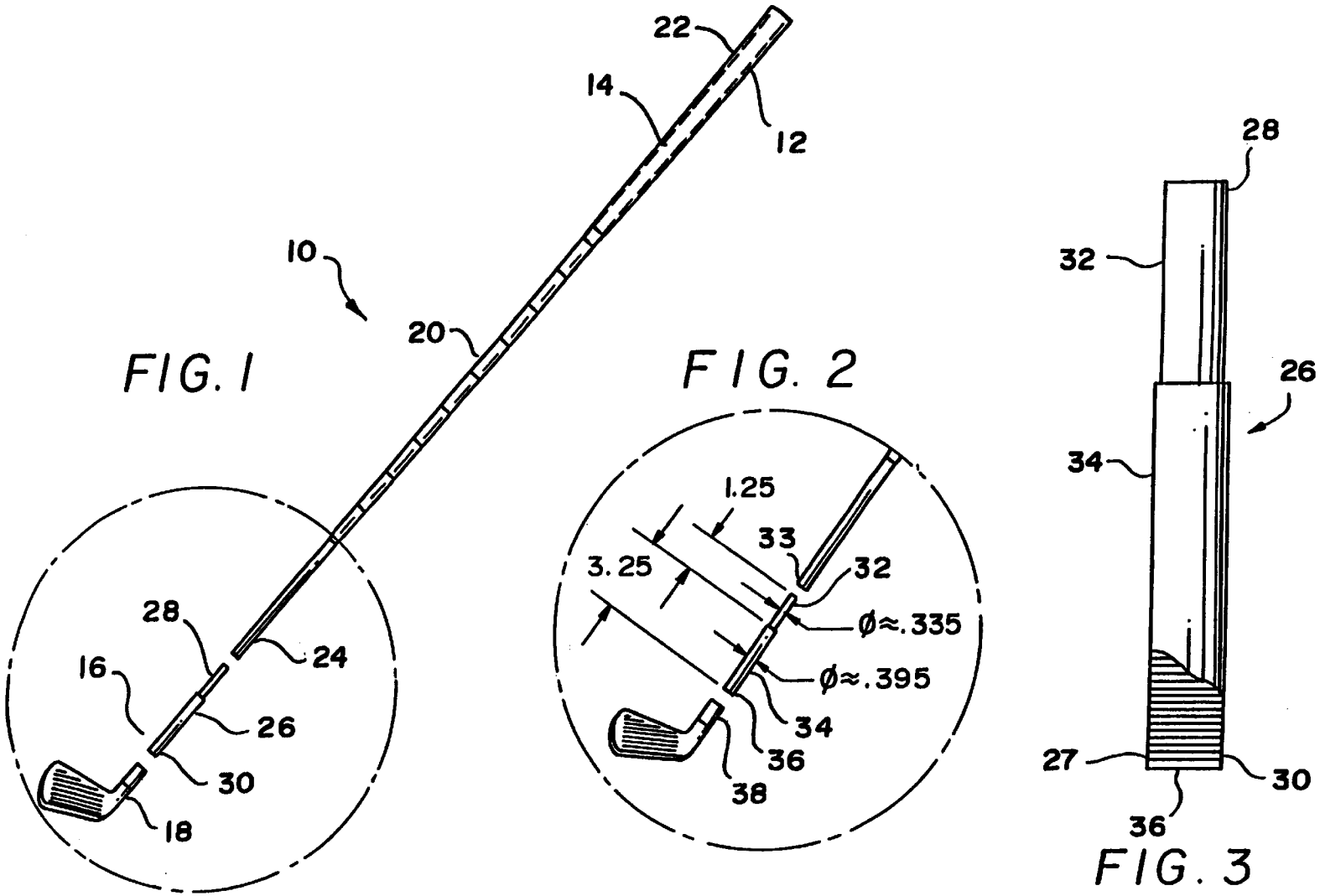
FIG. 1 is an exploded view of a golf club with the golf club shaft in accordance with the present invention.
FIG. 2 is a detailed view of the distal end of the golf club.
FIG. 3 is a partial cross sectional view of the second member.

With reference to FIG. 1, a golf club 10 in accordance with the present invention is disclosed. The club head 10 includes a two part shaft 12 formed of a butt end 14 to which a grip (not shown) is secured and a distal end 16 to which a golf club head 18 is secured.

The golf club shaft 10 of the present invention is constructed from a first member 20 including a first end 22 and a second end 24. The first member 22 extends from the first end 22 located at the butt end 12 of the shaft 10 to its second end 24 positioned slightly short of, or above, the distal end 16 of the golf club shaft 10.

A second member 26 is secured to the second end 24 of the first member 20 and extends axially from the second end 24 of the first member 20 to the distal end 16 of the golf club shaft axially from the second end 24 of the first member 20 to the distal end 16 of the golf club shaft 10. The second member 26 accordingly includes a first end 28 which is secured directly to the second end 24 of the first member 20 and a second end 30 which is ultimately secured to the golf club head 18.

A preferred embodiment of the present shaft 10 employs a second member 26 with an exposed length of approximately 2 inches, that is, the portion of the second member 26 exposed between the second end 24 of the first member 22 and the hosel 31 of the golf club head 18, while the remaining length of the golf club shaft 10 is composed of the first member 20. While a specific length is disclosed in accordance with a preferred embodiment of the present invention, the length of the second member 26 may be varied as discussed below without departing from the spirit of the present invention. For example, and as discussed in additional detail below, it is contemplated that the exposed portion is preferably less than approximately 5½ inches (an 8 inch second member with 1¼ inch sections respectively inserted within the hosel and first member upon assembly), and more preferably, the exposed portion is between 1 inch and 3 inches.

In accordance with a preferred embodiment of the present invention, the first member is constructed from a standard golf shaft grade metal, or metal matrix, preferably, a carbon steel. As such, the flexibility of the steel first member 20 may be selected to suit the swings of different golfers. It is also contemplated that the first member may be manufactured from a variety of other materials within the spirit of the present invention, but preferably materials that are isotropic so that their mechanical features are consistent.

The first member 20 is shaped and dimensioned to resemble a typical golf club shaft as it extends from the butt end 12 of the golf club shaft 10 toward the distal end 16 of the golf club shaft 10. The only difference being that the first member 20 ends at position short of the distal end 16 of the golf club shaft 10, thereby providing space for the placement of the second member 26 between the first member 20 and the golf club head 18. In fact, and in accordance with a preferred embodiment of the present invention, the first member 20 is formed by simply removing a preselected length of the tip end of a standard shaft, such as by way of example, the bottom 3¼ inches from a standard steel golf shaft.

The second member 26 is preferably a composite material chosen to dampen the vibrations coming from the club head 18 upon impact with a golf ball. The composite material, which is preferably a synthetic chemical compound, may be chosen to further improve the striking characteristics of a golf club by stabilizing the club head 18 upon impact with a golf ball and varying the flex characteristics of the golf club shaft 10 to suit different golfers.

The second member 26 includes a male attachment member 32 shaped and dimensioned to fit within the opening 33 provided in the second end 24 of the tubular steel shaft making up the first member 20. While the disclosed embodiment employs a second member with a male attachment member for positioning within the first member, those skilled in the art will appreciate the possible attachment variations (for example, providing the second member with a female attachment member) that may be used within the spirit of the present invention.

In accordance with a preferred embodiment of the invention, the attachment member 32 is formed with an outer diameter of approximately 0.335 inches. The remainder of the second member 26 is the main body 34 and is shaped to match the profile of a conventional golf club shaft at the position adjacent the distal end of the golf club shaft (for example, 0.395–0.400 inches in diameter). With that in mind, the free end 36 of the body 34 is shaped and dimensioned to fit within the hosel 38 of the golf club head 18 for attachment of the present golf club shaft 10 to the club head 18. In other words, the opening in the hosel is slightly greater than the diameter of the main body of the second member so that the free end of main body of the second member can be inserted into the hosel and epoxied into place.

The male attachment member 32 is slightly smaller than the opening 33 provided in the second end 24 of the first member 20 and is shaped to be compression fit therein. A secure attachment between the first and second members 20, 26 is ensured through the application of epoxy at the joint connecting the first and second members 20, 26.

In accordance with a preferred embodiment of the present invention, and with reference to FIG. 3, the second member is formed from a carbon fiber reinforced laminated plastic, manufactured by Current Laminated Plastics, Inc.

The carbon fiber reinforced laminated plastic material is formed from carbon fiber cloth that is 8 feet wide by 1000 yards long, with the carbon fibers being oriented only in a lengthwise direction. In an illustrative process, the carbon fiber cloth is run through a resin bath and subsequently through an oven where the resin is cured. The resin coated cloth is then cut into 200 yard long rolls, and from the rolls it is cut into 8 foot lengths using a sheeting machine. The 8 long sheets of resin coated cloth are cut to 50 inch widths and then stacked to a depth of ½ inches so that the stack assumes a dimension of 50 inches by ½ inch by 8 feet. The stacked sheets are subsequently put into a laminating press which applies heat under pressure to activate the resin and the stack of sheets are left in the press for approximately two hours.

The resulting blocks of laminate material removed from the laminating press are cut to 4 foot lengths, and subsequently into elongated bars of the laminated material. The bars have a dimension of ½ inch by ½ by 4 feet, with the laminations extending perpendicularly to the length of the bars. The bars are then turned on a lathe and machined into a cylindrical configuration that is, by way of example, approximately 0.395 inches in diameter. Thereafter, spaced segments of the cylindrical bar are further reduced to a diameter of, for example, 0.335 inches (to create the male attachment members 32). The reduced diameter portions of the cylindrical bar are, for example, approximately 1¼ inches long and are spaced, for example, approximately 3¼ inches apart. The cylindrical bar is then cut into a plurality of pieces that are approximately 4½ inches in length, with the cuts occurring at the same ends of the reduced diameter portions of the cylindrical bar. The individual pieces formed from the cylindrical bar constitute a preferred embodiment of the second member 26 of the golf shaft of the present invention.

The carbon fiber resin laminated plastic can produce very stiff second members which may be desirable to those golfers desiring a stiffer shaft with minimal vibration. In contrast to graphite shafts previously used throughout the golf industry, the second member formed from composite materials in accordance with the present invention exhibits exceptional consistency in a highly repeatable product.

The second member 26 may be formed from other composite materials without departing from the spirit of the present invention. We have found that similar results are also achieved by second members manufactured from G10, fiberglass reinforced resin laminated plastic, manufactured by Current Laminated Plastics, Inc. Second members made from fiberglass reinforced resin laminated plastic are manufactured in a manner substantially identical to the second members manufactured from carbon fiber reinforced laminated plastics discussed above.

While a specific method for manufacturing the second member from carbon fiber reinforced resin laminate blank is disclosed above, other methods may be used in the manufacture of the second member 26 without departing from the spirit of the present invention. For example, it is contemplated that the carbon fiber or fiberglass reinforced second members may be manufactured by injection molding, mandrel wraps as commonly used in the manufacture of current hollow graphite shafts or other techniques commonly used in the manufacture of resin based products.

As briefly discussed above, the second member is preferably formed with an exposed length of approximately 2 inches. The second member is, therefore, formed as a 4½ solid cylinder with a male attachment member 32 having a length of approximately 1¼ inches. The free end 36 of the second member 26 is designed for insertion within the hosel 38 of a standard golf club head 18, for example, approximately 1¼ inches of the second member 26 are inserted within the hosel 38, leaving a length of approximately 2 inches as the exposed length of the second member.

As discussed above, the exact lengths of the first and second members 20, 26 are not critical to the overall function of the present invention, and these lengths may be varied without departing from the spirit of the present invention. It is contemplated that while the preferred embodiment is constructed with a 4½ long second member 26, the second member 26 should be constructed with a length of less than approximately 8 inches. The choice of 8 inches as the preferred maximum length is based upon the understanding that it is accepted in golf, through empirical research, that only the first 8 inches of a shaft (from the tip end) determine the playability characteristics during of impact. In fact, the characteristics of the shaft beyond 8 inches do not affect the shaft performance at the time of impact.

The resulting golf club shaft 10 manufactured from first and second members 20, 26 as discussed above exhibits many of the advantages of steel shafts, without the shortcomings of steel shafts. Specifically, the resulting golf club shaft 10 offers the consistency of a steel shaft without the vibrations considered undesirable by many golfers. In addition, the resulting golf club shaft 10 is similar to steel shafts in weight, balance point, bending stiffness (i.e., shaft flex), torsional stiffness and longitudinal stiffness (i.e., the response of the shaft to pulling from opposite ends of the shaft). The present golf club shaft 10 thereby provides the consistency of steel at the point where the shaft flexes, and the feel and playability of fiber reinforced resins where most of the shock is absorbed, thus minimizing vibrations transmitted up the shaft to the hands of a golfer.

Vibrational tests have been performed on the golf club shaft discussed above with impressive results. The tested golf club shafts were constructed with a True Temper Dynamic Golf S300 taper steel shaft with 3¾ inches cut from the tip of the shaft (the first member) and a 4½ long solid cylinder made from G10 in the manner discussed above (the second member). The first and second members were assembled by placing the male attachment member of the second member within the second end of the first member and using epoxy to securely bond the first and second members together.

Figure 4:
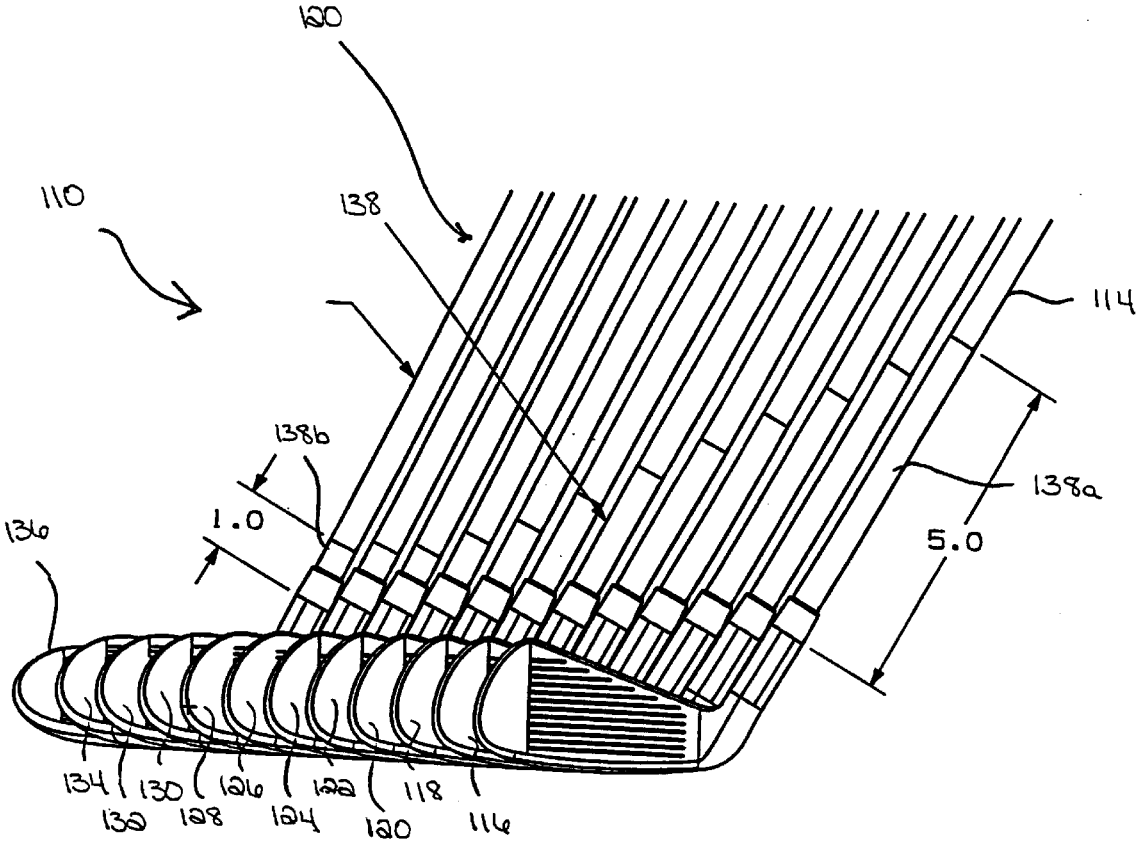
FIG. 4 shows a set of golf clubs in accordance with the present invention.

The results of the tests are shown in FIGS. 4 and 5 of U.S. patent application Ser. No. 09/399,332 which is incorporated herein by reference. FIG. 4 shows the vibration profile for a complete steel shaft. The high amplitude peaks with narrow bases exhibited by the steel shaft demonstrate substantial undesirable vibrations. FIG. 5 shows the vibration profile for the golf club shaft 10 manufactured in accordance with the present invention. The present golf club shaft 10 exhibits lower amplitude peaks with much wider bases. The lower amplitude peaks and wider bases demonstrate the clear reduction in vibrations resulting from the use of the present golf club shaft.

The use of distinct first and second members in accordance with the present invention allows for the manufacture of golf club shafts tailored to suit the specific needs of individual golfers. Specifically, the second member may be readily varied to alter the following characteristics of a golf club shaft: torsional stiffness (torque), bending stiffness (shaft flex), longitudinal stiffness and dampening. For example, the material of the second member may be composited to form a variety of consistent bending flex characteristics at the distal end of the golf club. As a result, the overall feel of the present shaft may be matched to a specific golfer's swing by varying the first and second member to provide optimum performance.

In addition to the many advantages discussed above, the present invention permits the manipulation of graphite characteristics in an economical manner. For example, if a company currently wished to come out with a production line of graphite shafts having specific consistent mechanical characteristics, they would be forced to purchase thousands and thousands of shafts, which would then be individually tested against each other to try and come up with as many matched sets as possible. The remaining shafts would then be thrown away or sold at a loss. The use of steel shaft members, small carbon fiber second members, and highly consistent carbon fiber second members in accordance with the present invention allows for the manipulation of graphite characteristics in a far more economical manner.

Referring to FIG. 4, the teachings of the present invention are applied to improve the striking characteristics of a series, or set, of golf clubs 110. Application of the disclosed technology is applied in a such a way to optimize the teachings associated with the use of an insert according to the present invention for use with clubs of differing lofts.

It will be appreciated that the upper portions of the shafts 112 on each of the clubs are not shown to simplify the description, and that the upper butt end of the shaft is connected to a suitable grip or a handle (not shown) as is well known in the manufacture of conventional golf clubs.

In accordance with a preferred embodiment of the present invention, the golf clubs pictured in FIG. 4 range from a two iron 114 to a lob wedge 138; the numbered irons extend from two through nine 114, 116, 118, 120, 122, 124, 126, 128 and four high lofted wedge type clubs including a pitching wedge 130, gap wedge 132, sand wedge 134 and lob wedge 136 are shown. Preferably, the low lofted iron clubs range from a loft of approximately 16° to the higher lofted golf clubs which may have a loft of approximately 60°. Furthermore, the overall length of each of the golf clubs becomes progressively shorter as the loft of the golf clubs increase toward the wedges.

According to a preferred embodiment of the disclosed set of golf clubs, the overall length of the second member 138 (not including the male attachment member 32 discussed above with regard to FIGS. 1 through 3) extends from approximately 6.25 inches for the longest low loft iron (2 iron) 114 to approximately 3 to 4 inches for the most lofted wedge iron (lob wedge) 136. For example, it is contemplated that the second member 138*a* for the 2 iron 114 will be approximately 6.25 inches with at least 4.45 of the 6.25 inches being exposed. It will be appreciated that the remaining 1.8 inches of the second 138*a* member are inserted in the hosel to connect the shaft to the club head. The highest lofted golf club (as well as the shortest) 136 includes a second member 138*b* that may be as short as 3 to 4 inches with only slightly greater than approximately 1 inch being exposed. Referring to the drawings, it can be seen that the exposed second members 138 become progressively longer as the club heads become less lofted and the golf clubs become longer.

Refer to the following chart which shows overall length of the second member for the corresponding loft angle and length of each golf club. The chart below states the total length of the second member (excluding the male attachment member 32 which is inserted within the first member for attachment thereto and is discussed above). In accordance with a preferred embodiment of the present invention, the hosel depth is approximately 1.3 inches and the ferrel depth is approximately 0.5 inches. As such, the exposed length of each second member may be arrived at by subtracting 1.8 inches from the stated total lengths.

| Iron Type | Shaft Length (Inches) | Second Member Length (Inches) |
|---|---|---|
| 2 Iron | 39½ | 6.25 |
| 3 Iron | 39 | 6.25 |
| 4 Iron | 38½ | 5.75 |
| 5 Iron | 38 | 5.25 |
| 6 Iron | 37½ | 4.75 |
| 7 Iron | 37 | 4.25 |
| 8 Iron | 36½ | 3.75 |
| 9 Iron | 36 | 3.25 |
| Pitching Wedge | 35¾ | 3 |
| Gap Wedge | 35½ | 3 |
| Sand Wedge | 35½ | 3 |
| Lob Wedge | 35½ | 3 |

While various preferred embodiments have been shown and described, it will be understood that there is no intent to limit the invention by such disclosure, but rather, is intended to cover all modifications and alternate constructions falling within the spirit and scope of the invention as defined in the appended claims.

What is claimed is:

1. A set of golf clubs, comprising:

a plurality of golf clubs having varying lofts extending from lower loft golf clubs to higher loft golf clubs, wherein each golf club includes a club head and a shaft having a distal end and a butt, wherein each shaft includes:

a first member having a first end located at the butt end of the golf club shaft and a second end positioned slightly short of the distal end of the golf club shaft; a second member secured to the second end of the first member, the second member extends from the second end of the first member to the distal end of the golf club shaft and includes a first end securely coupled to the second end of the first member and a second end which is ultimately secured to a golf club head;

wherein the second member progressively decreases in length as the plurality of golf clubs extend from the lower lofted golf clubs to the higher lofted golf clubs; and wherein the first member is formed from a rigid material offering mechanical consistency and the second member is formed from a vibration absorbing material which absorbs undesirable vibrations resulting from an individual striking a golf ball.

2. The set of golf clubs according to claim 1, wherein the first member is formed from a rigid material offering mechanical consistency and the second member is formed from a material controlling the bending and torsional stiffness at the distal end of the golf club shaft upon striking a golf ball to thereby stabilize a golf club head secured to the distal end of the golf club shaft.

3. The set of golf clubs according to claim 1, wherein the second member is formed from a synthetic chemical compound.

4. The set of golf clubs according to claim 3, wherein the second member is formed from a fiberglass reinforced resin.

5. The set of golf clubs according to claim 3, wherein the second member is formed from a carbon fiber reinforced resin.

6. The set of golf clubs according to claim 1, wherein the first member is formed from steel.

7. The set of golf clubs according to claim 1, wherein the second member is approximately 6.25 inches in length for the lowest loft golf club and the second member is approximately 3 inches for the highest loft golf club.

8. The set of golf clubs according to claim 1, wherein the second member is a solid core construction.

9. The set of golf clubs according to claim 1, wherein said second member of each golf club shaft is progressively longer as the overall length of the golf club increases.

* * * * *